United States Patent [19]

Thomas

[11] 4,235,448

[45] Nov. 25, 1980

[54] SKIING SIMULATOR

[76] Inventor: Brooks Thomas, 921 Nardo, Encinitas, Calif. 92024

[21] Appl. No.: 859,040

[22] Filed: Dec. 9, 1977

[51] Int. Cl.[3] ..... A63C 17/04

[52] U.S. Cl. ..... 280/11.1 BT; 280/87.04 A

[58] Field of Search ..... 280/11.1 ET, 11.1 BT, 280/11.1 BR, 11.1 R, 11.19, 87.04 R, 87.04 A; 272/97, 70, 1 R; 35/29 R

[56] References Cited

U.S. PATENT DOCUMENTS

| | | | |
|---|---|---|---|
| D. 242,735 | 12/1976 | Candler | 280/87.04 A |
| 3,306,626 | 2/1967 | Kawada | 272/1 R |
| 3,620,547 | 11/1971 | Vavarek | 280/87.04 A |
| 3,671,055 | 6/1972 | Aarup | 280/87.04 A |
| 3,684,305 | 8/1972 | McDonald et al. | 280/87.04 A |
| 3,856,321 | 12/1974 | Solymosi | 280/11.1 R |
| 3,967,820 | 7/1976 | Harper | 272/1 R |

FOREIGN PATENT DOCUMENTS

| | | | |
|---|---|---|---|
| 421765 | 11/1925 | Fed. Rep. of Germany | 280/11.1 BT |

*Primary Examiner*—David M. Mitchell
*Attorney, Agent, or Firm*—Lyon & Lyon

[57] ABSTRACT

A skateboard-type platform is described using standard skateboard hardware including wheels, axles, trucks, and mounting devices and including a lowered platform for placement of the user's feet in a parallel position thus simulating the foot placement, posture, and turning motions involved in snow skiing.

2 Claims, 5 Drawing Figures

SKIING SIMULATOR

BACKGROUND OF INVENTION

A variety of sports have centered around devices which enable a man to travel rapidly across a ground surface using low friction devices mounted on his feet. Examples of such sports are ice skating, snow skiing, roller skating, and most recently, skateboarding. The present invention addresses long-standing problems involving training in difficult techniques of snow skiing utilizing technology from the more recently developed sport of skateboarding.

Training systems for snow skiing require application in a non-snow environment for wide and year round application. The wheeled device is ideal for practicing on dry ground. Most wheeled devices, however, of which skateboards are a significant example, differ radically in the techniques involved in turning while using the devices. Skateboards are typically ridden using a fore and aft placement of the rider's feet and developing radical turning moments by leaning the rider's body weight in the direction of the turn causing the skateboard platform to incline sharply into the direction of the turn. Such sharp angles of inclination are enabled by the relatively high vertical distance that the board is supported above the ground. Snow skis by contrast, are much closer to the ground, to the point that the bottom surface is in actual contact with the ground. The incline of the platform into the turn in skiing and the rider's body positions required to initiate and sustain turns, in addition to downhill side slip involved in skiing, provides few, if any, correlations with skateboarding techniques. A typical skateboard device is disclosed for example in Stevenson, skateboard with inclined foot depressable lever, U. S. Pat. No. 3,565,454.

Other attempts to provide a wheeled dry land skiing trainer have been complex for example Sessa, wheeled ski skate, U.S. Pat. No. 3,891,225, and involving unique hardware which diminishes the correlation with actual skiing movements or have, like skateboards, been supported at relatively high distances from the ground, for instance, Kunselman, roller skiis, U.S. Pat. No. 3,436,088, destroying their correlation with actual skiing movements as described above.

SUMMARY OF THE INVENTION

Thus it is an object of the present invention to provide an effective dry land training device for snow skiing that closely simulates the actual motions involved in turning on snow skis.

Another objective is to provide a dry land ski training device in which the rider's feet are maintained in the classic parallel skiing configuration.

Another objective of the device is to provide a dry land ski training device that can be used on a wide variety of dry land surfaces such as ground, cement or asphalt.

Another object of the present invention is to provide a ski training device using widely available hardware for economy of construction and ease of availability.

The objects just stated are met in the present invention by embodying the following features:

An elogated narrow platform is provided in a length somewhat longer than a rider's feet supported by standard skateboard hardware at each end including trucks, axles, and wheels. Mounted on a plane lower than the longitudinal platform are two foot plates in a configuration that holds the feet in a parallel position and on a plane lower to the ground than the supporting longitudinal platform. The rider is thus placed in a position similar to snow skiing, feet parallel, close to the ground, and in a forward crouch induced by the forward leaning angle of the foot plate. The feet are further maintained in the correct position by a flange on the outer edges of the foot plates which encloses the sole of the rider's shoe. The wide low stance of the overall configuration placing the feet in a parallel position low to the ground, limits the angle at which the board can be leaned into the turn. Excessive leaning into the turn will cause the bottom of the uphill foot plate to contact the ground and cause traction loss on the downhill wheels; the rider's weight distribution must then be corrected. Thus, the rider's posture conforms identically to the classic body positions required to turn snow skis: weight approximately evenly on the skis and centered over the skis, with the turning moment initiated by an unweighting manuever from traverse to traverse across and down the hill.

BRIEF DESCRIPTION OF DRAWINGS

The attached drawing, consisting of one sheet, contains five figures which are views of my invention in several perspectives or modes.

DESCRIPTION OF PREFERRED EMBODIMENT

Figure 2:
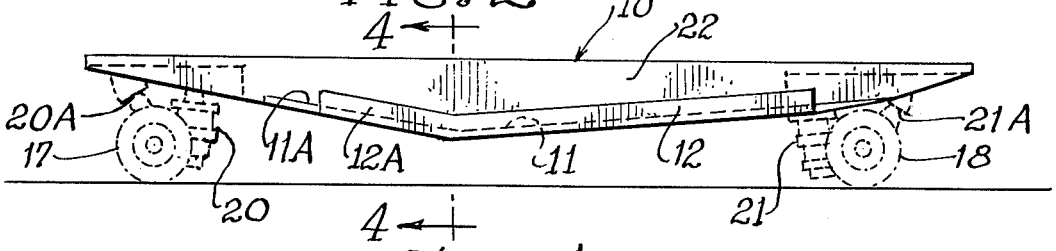
FIG. 2 is a side view of the device.
Figure 1:
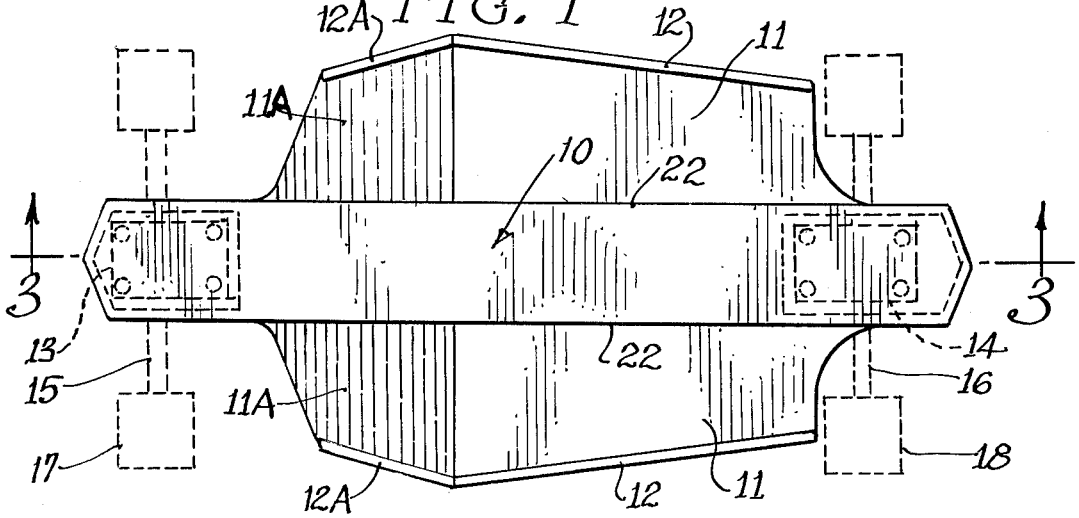
FIG. 1 is a plan view of the device showing all the details described above and in the detailed description.

With reference to FIG. 1, the enlongated supporting platform 10 is further supported by the standard skateboard hardware comprising the mounting plate 13 on the forward end of the board shown at the left side of the drawing and mounting plate 14 on the rearward end of the board at thr right side of the drawing. Axles 15 and 16 and wheel assembly 17 and 18 are also standard skateboard hardware. Vertical side walls, 22, extend downward perpendicularly from the supporting platform and are attached to a foot plate, 11, on either side. The aft section of the foot plate closes the rider's foot from the heel forward to the ball of the foot and the toe of the rider's shoe rests on the forward section of the foot plate, 11*a*. The foot is further enclosed by a side flange, 12, perpendicular to the foot plate, 11, and a side flange, 12*a*, perpendicular to the foot plate section, 11*a*. Thus a foot well is formed on either side of the supporting platform substantially lower than the plane of the platform in contrast to a typical skateboard configuration in which the entire supporting foot surface would be at the higher platform plane. FIG. 2 further illustrates the vertical relationship between the foot plate and the supporting platform. Foot plate section 11 is inclined downwardly from the aft section toward the forward section and foot plate section 11*a* is inclined upwardly from the point of the ball of the user's foot at the intersection between the two plate sections. The effect of the change in incline of the foot plate is to thrust the rider's weight forward on his toes in the same posture required in snow skiing. Additionally, FIG. 2 illustrates that standard skateboard hardware supports the upper platform on the wheels; forward skateboard truck 20 and its turning pivot 20*a* are illustrated as well as aft truck 21 and its pivot 21*a* mounted in opposite direction from the forward truck in order that the assemblies will induce a turn in the same direction at the same time; i.e., in a left turn, truck 20 will turn axle 15 counter clockwise as viewed from FIG. 1 and truck 21 will turn axle 16 clockwise as viewed in FIG. 1.

Figure 3:
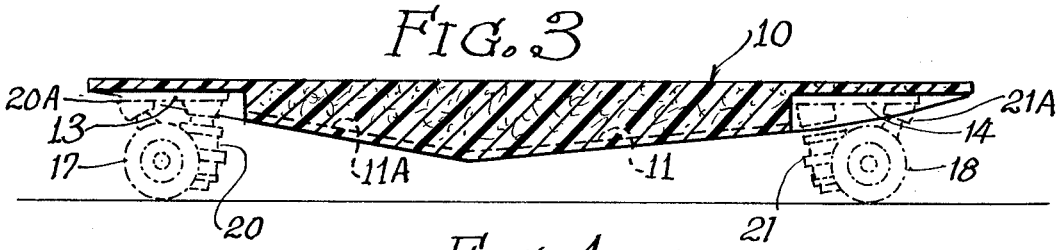
FIG. 3 is a side view cut away section along Section Lines 3—3 of FIG. 1.

FIG. 3 shows in cross section that the device may be constructed in solid form by casting or molding providing adequate vertical support for the foot plates to be rigidly attached to the same horizontal position as the supporting platform, and the solid portion is cut away for mounting of the skateboard hardware fore and aft.

Figure 4:
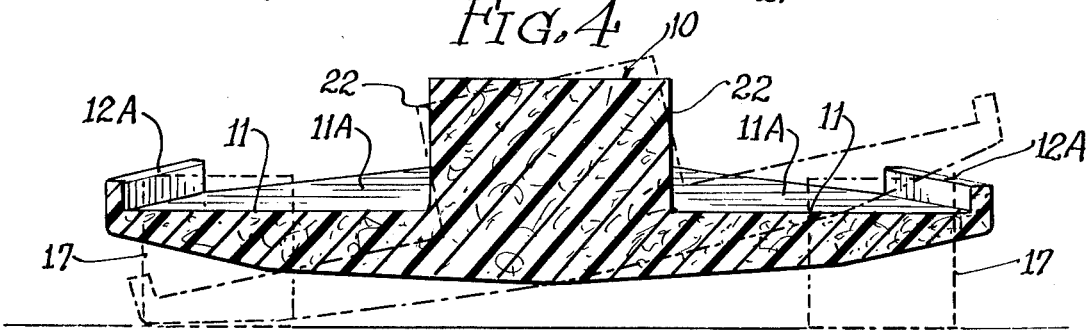
FIG. 4 is a vertical cross section along Section Lines 4—4 of FIG. 2 looking forward along the longitudinal axis.

FIG. 4 further illustrates that the device may be constructed solidly by casting or molding, clearly showing that the unit presents a solid cross section at its midpoint. Additionally, FIG. 4 illustrates that the board will contact the ground on its lower side if it is pivoted too far into the turn, limiting the rider's body position which would otherwise tend to lean more markedly into the hill.

Figure 5:
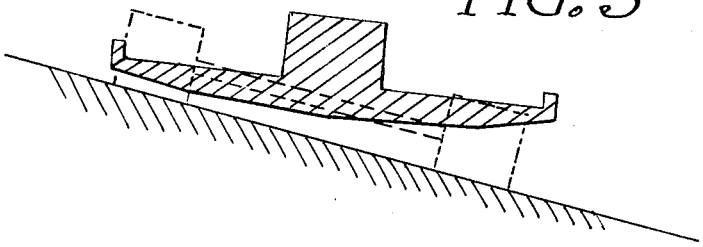
FIG. 5 is a cross section view from the same perspective as FIG. 4 illustrating the board in operation traversing a slope.

Finally, FIG. 5 shows the approximate posture of the board in cross section while traversing an inclined ground surface. The board is tilted slightly uphill relative to the axle, which turns the trucks slightly inducing a turn as described above. A significant amount of the rider's weight, however, must be maintained in the downhill foot well, a posture similar to the weighting requirement on the downhill ski in snow skiing. Skateboarding by contrast, typically favors sharp turns and placement of a high proportion of the rider's weight on the inside or uphill edge of the board.

Thus, in operation, the motion and posture required of the rider of the within described invention, closely simulates that required of a snow skier: feet parallel and close together, weight forward and centered over the platform evernly with significant weight on the downhill side producing a balanced dynamic condition resulting in the classic carved turn across a slope.

Having thus described my invention, I claim:

1. A wheeled sport device comprising:

an elongate platform having a center line in the elongate direction, an upper side and lower side;

first and second skateboard truck, axle and dual wheel assemblies at either end of said elongate platform on said center line and having mounting surfaces engaging said platform on said lower side; and first and second foot plates in side by side arrangement on either side of said elongate platform and having upper surfaces substantially lower than said upper side of said elongate platform, each said upper surface having first and second sections converging downwardly to an intersection substantially transverse to said center line from either end of said foot plate.

2. The wheeled sport device of claim 1 wherein each said foot plate includes a flange along the outer edge thereof extending upwardly from said upper surface.

* * * * *